United States Patent [19]

Johnson et al.

[11] Patent Number: 4,667,986

[45] Date of Patent: May 26, 1987

[54] WELLHEAD CONNECTOR

[75] Inventors: David J. Johnson, Garland, Tex.; Mark L. McGinnis, Ventura, Calif.

[73] Assignee: Otis Engineering Corporation, Dallas, Tex.

[21] Appl. No.: 663,476

[22] Filed: Oct. 22, 1984

[51] Int. Cl.[4] ..... F16L 35/00

[52] U.S. Cl. ..... 285/24; 285/83; 285/306; 285/316; 285/317; 285/920

[58] Field of Search ..... 285/83, 102, 105, 306, 285/316, 317, DIG. 25, 321, 24, 315, 920; 166/341

[56] References Cited

U.S. PATENT DOCUMENTS

| | | | |
|---|---|---|---|
| 2,245,847 | 6/1941 | Bagby | 285/83 |
| 3,077,330 | 2/1963 | Lamphear | 285/83 X |
| 3,147,992 | 9/1964 | Haeber et al. | 285/DIG. 21 X |
| 4,200,312 | 4/1980 | Watkins | 285/316 X |

FOREIGN PATENT DOCUMENTS

| | | | |
|---|---|---|---|
| 992347 | 5/1965 | United Kingdom | 285/DIG. 21 |
| 281971 | 9/1970 | U.S.S.R. | 285/315 |

OTHER PUBLICATIONS

Completion of Subsea Well, Petroleum Engineer, May 1971, 4 pages.

Methods for Servicing Subsea Equipment are Improving, World Oil, Apr. 1982, 4 pages.

Noroil, pp. 201, Aug. 1982.

Latch System Speeds Stem Tests, Drilling Contractor, Feb. 1984, p. 43.

*Primary Examiner*—Dave W. Arola

*Attorney, Agent, or Firm*—Roland O. Cox

[57] ABSTRACT

A connector useful in releasably connecting well servicing equipment to wellheads. A male connector member houses resilient seals sealingly engageable in the female member on connection. The female connector member houses radially moveable dogs which may be locked in connecting engagement in a groove on the male connector by a lock sleeve longitudinally moveable over the dogs. The sleeve is longitudinally moveable in response to pressure and is biased toward dogs locked position and may be retained there by application of pressure through a first inlet in the sleeve. The female connector houses a pressure lock which prevents movement of the lock sleeve on application of pressure to a second lock sleeve inlet, if there is pressure in the connector bore. The connector is releasable for disconnect when there is no pressure in the connector bore and pressure is applied through the second lock sleeve inlet, moving the sleeve longitudinally to allow the dogs to be cammed out of engagement with the male connector groove, when the female connector is moved to disconnect.

6 Claims, 5 Drawing Figures

WELLHEAD CONNECTOR

BACKGROUND

This invention relates to devices for connecting well servicing and like equipment to wellheads. The invention particularly relates to remotely actuated connectors especially useful for connecting and disconnecting equipment to and from underwater wellheads.

A number of remotely actuated connectors have been developed and are being used during well servicing operations. These remotely actuated connectors eliminate manual connector operation and repeated requirements for expensive divers when connecting well servicing equipment to and disconnecting it from underwater wellheads.

One of these devices is described in an article entitled "Latch System Speeds Stem Results" on page 43 of the February, 1984 issue of "Drilling Contractor" magazine, which is published in Houston, Tex.

Examples of two riser connectors, remotely operated by shifting tools and used underwater in ocean floor well operations, are disclosed in U.S. Pat. Nos. 4,307,902 and 4,411,455 to Schnatzmeyer. An example of a hydraulically actuated connector which may be remotely actuated is shown in U.S. Pat. No. 4,337,971 to William D. Kendrick. These connectors can be disconnected with pressure in the connector bore, resulting in possible loss of pressure control of the well and serious disaster.

SUMMARY OF THE INVENTION

The wellhead connector of this invention provides a remotely operable connector having male and female members, one of which may be connected to servicing equipment to be releasably connected to a wellhead and the other to an underwater wellhead. Pressure may be selectively applied from a remote source to inlets in the female member to move a longitudinally moveable sleeve and position this member in released or locked position. An additional lock, responsive to pressure in the female connector bore, prevents the longitudinally moveable sleeve from being moved by remote pressure, positively preventing intentional or unintentional release and disconnect of the connector when there is pressure in the female connector bore. Once the connector members are in place, the connector may be operated remotely to easily, quickly and repeatedly connect and disconnect the well servicing equipment to and from the wellhead of the well being serviced.

An object of this invention is to provide a wellhead connector requiring no manual operation at the connector.

Another object of this invention is to provide a wellhead connector operable to connect and disconnect by a remote pressure source.

Another object of this invention is to provide a wellhead connector, operable from a remote pressure source, which may be locked connected by continued application of pressure.

Also an object of this invention is to provide a wellhead connector which cannot be disconnected, either intentionally or unintentionally, when there is pressure in the connector bore.

DESCRIPTION OF THE PREFERRED EMBODIMENT

Figure 1:
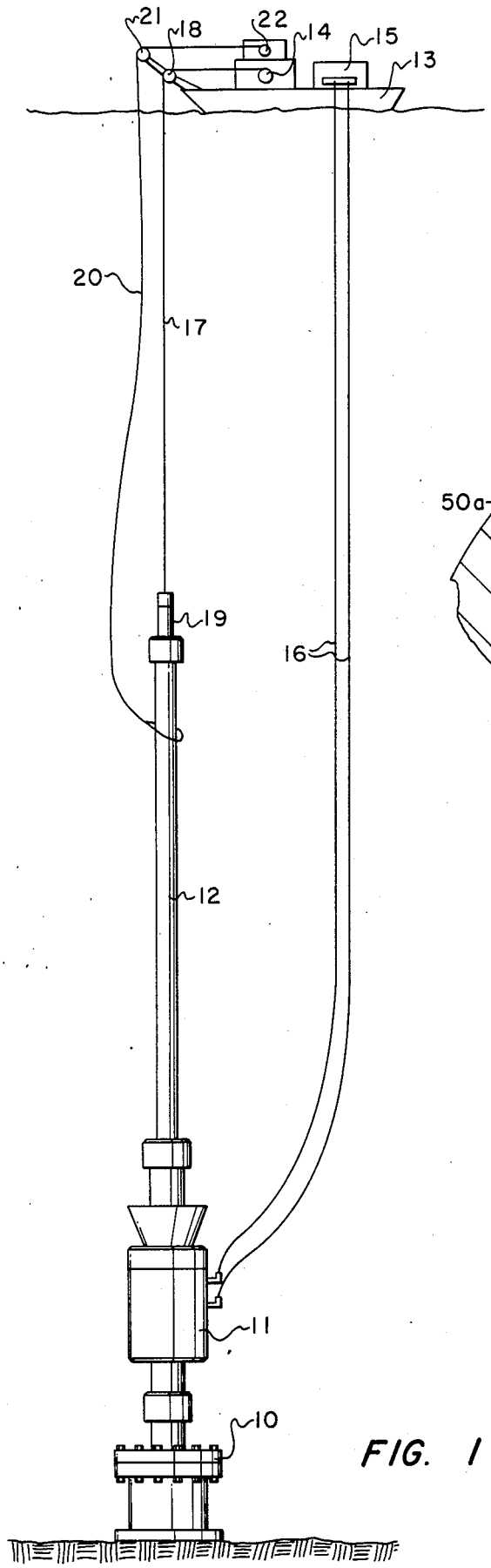
FIG. 1 is a schematic drawing of an ocean floor well utilizing the wellhead connector invention of this application, while being serviced.

FIG. 1 shows schematically an ocean floor wellhead 10, utilizing a remotely operable connector 11 of this invention to connect a lubricator 12 to the wellhead for servicing the well. A service boat 13, on the ocean surface, has a wireline reel 14 and a pressure source 15. Hoses 16 connected to the pressure source and the invention connector, conduct pressured fluid between the pressure source and connector. A wireline 17 is connected to the reel and passes over a sheave 18 and through a stuffing box 19 into the lubricator and well. A handling cable 20, attached to the lubricator, passes over a cable sheave 21 and is connected to a cable reel 22 on the boat. After connecting a connector member to the wellhead and a connector member to the lubricator or other well servicing equipment, the lubricator may be lowered and the connector operated remotely to connect or disconnect and raise the lubricator or other well servicing equipment as often as required during well servicing operations.

Figure 2:
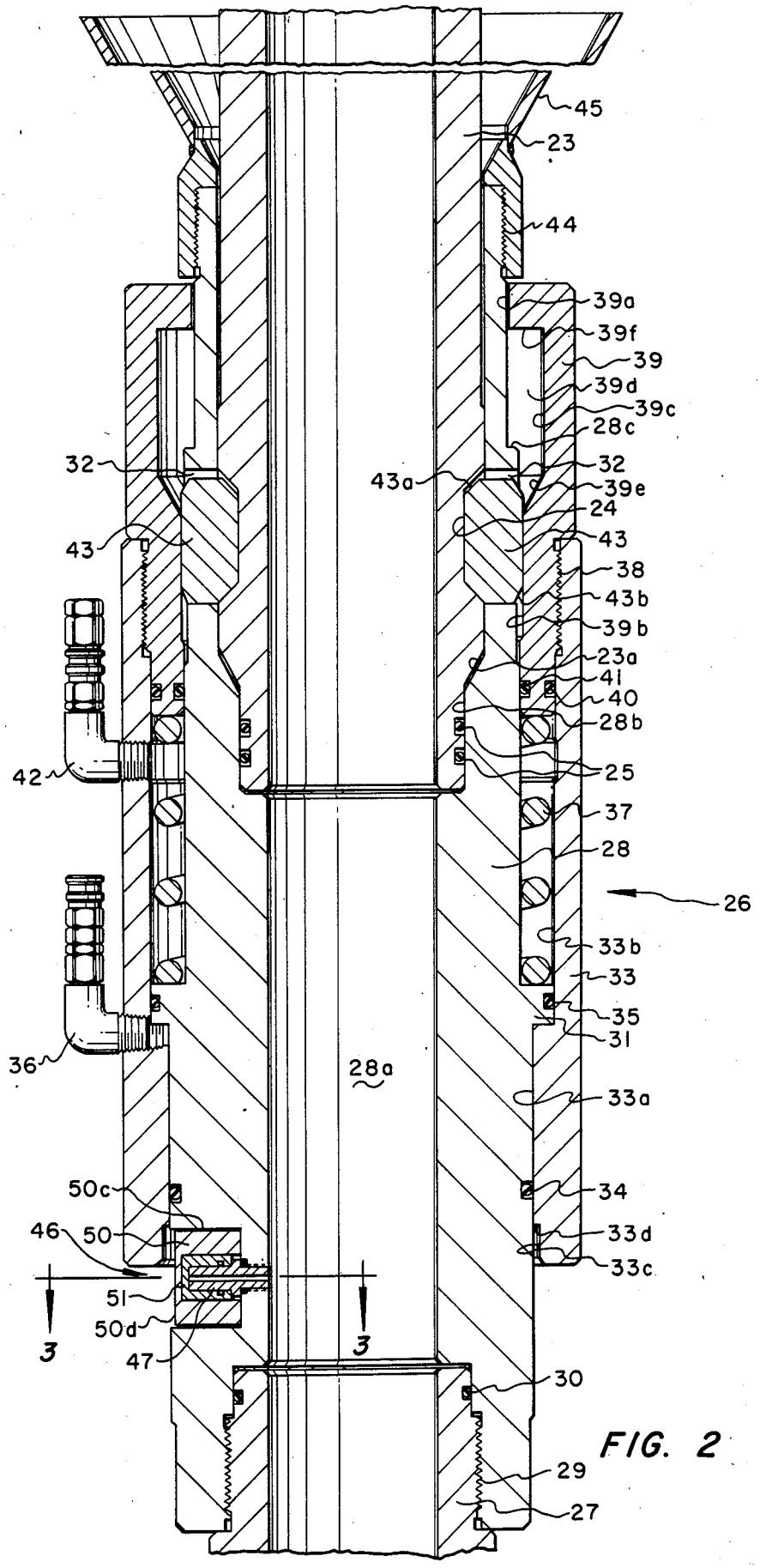
FIG. 2 is a sectioned drawing of the connector of this invention showing the members of the connector of the invention connected.

The invention connector 11 shown in FIG. 2 includes a male member 23, having an appropriate connection on its upper end for connection to well servicing equipment to be connected to the wellhead. The male member has an external groove 24, a cam surface **24*a*, and houses resilient seals 25 in grooves near its lower end. An external camming surface 23*a*** is provided between the resilient seals and groove.

The female connector member 26 includes a lower body 27 which has an appropriate connection on its lower end to connect the female member to the wellhead. The upper end of the lower body is connected to body 28 with thread 29 and sealed to the body with resilient seal 30. The body has a through bore **28*a*, a seal bore 28*b*, a shoulder 28*c*, an external flange 31, and openings 32. A longitudinally moveable sleeve 33 is mounted around the lower portion of the body and the flange and has seal bores 33*a* and 33*b*. Bore 33*a* is slidably sealed to the body with resilient seal 34 and bore 33*b* is slidably sealed to the flange with resilient seal 35. The lower end of the sleeve has a counterbore 33*c* which forms a shoulder 33*d* with bore 33*a*. The sleeve is fitted with an inlet 36, which is connected to a conduit, to conduct control fluid from a remote pressure source to act on the sealed annular area between resilient seals 34 and 35. Mounted around the body in sleeve bore 33*b* is a spring 37**.

Mounted around body 28 and connected to the upper end of the sleeve with threads 38 is a lock sleeve 39, which is sealed to the sleeve with resilient seal 40 and slidably sealed to the body with resilient seal 41. The lock sleeve retains spring 37 in bore **33*b* and has bores 39*a*, 39*b*, and 39*c*, which form an internal recess 39*d* in the lock sleeve. A conical surface 39*e*, connects bores 39*b* and 39*c* and shoulder 39*f* extends from bore 39*a* to bore 39*c*. Sleeve 33 is fitted with another inlet 42, which is connectable to a conduit, to conduct control fluid from a remote pressure source to act on the annular area between seals 35 and 41**.

Mounted for radial movement in each body opening 32, is a lug 43 having camming surfaces 43*a*, 43*b* and 43*c*. Connected to the upper end of the female connector body 28 with threads 44 is a frusto-conical guide 45, useful to guide the male member into the female member for connection.

Figure 3:
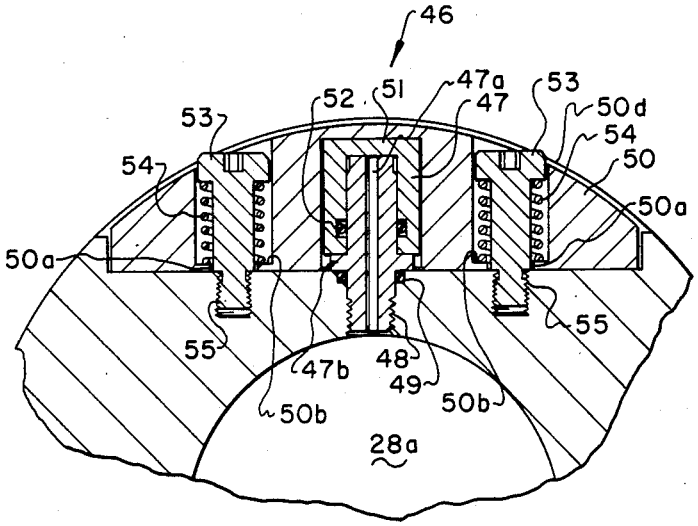
FIG. 3 is the drawing of a fragment of a section along lines 3—3 of FIG. 2.

Housed in a recess in the lower wall of body 28 is a connector lock 46. As shown by FIG. 3, the lock includes a rod 47 with a through flow passage 47*a* and an external flange 47*b*. The rod is connected in the wall recess to body 28 with thread 48 and one end of flow passge 47*a* in communication with body bore 28*a*. The rod is sealed to the body with resilient seal 49. Mounted over the rod in a recess in sleeve stop 50 is a piston 51, slidably sealed to the rod with resilient seal 52. Any pressure in bore 28*a* may act through flow passage 47*a* on the area sealed by seal 52. The sleeve stop has through holes 50*a* with internal shoulders 50*b*. Additionally, the stop has a side surface 50*c* and an arcuate surface 50*d*. The diameter of surface 50*d* is very slightly less than the diameter of bore 33*c*. Mounted around a shoulder screw 53 in each hole is a spring 54 and each screw is connected to the bottom of the body wall recess by threads 55.

Figure 4:
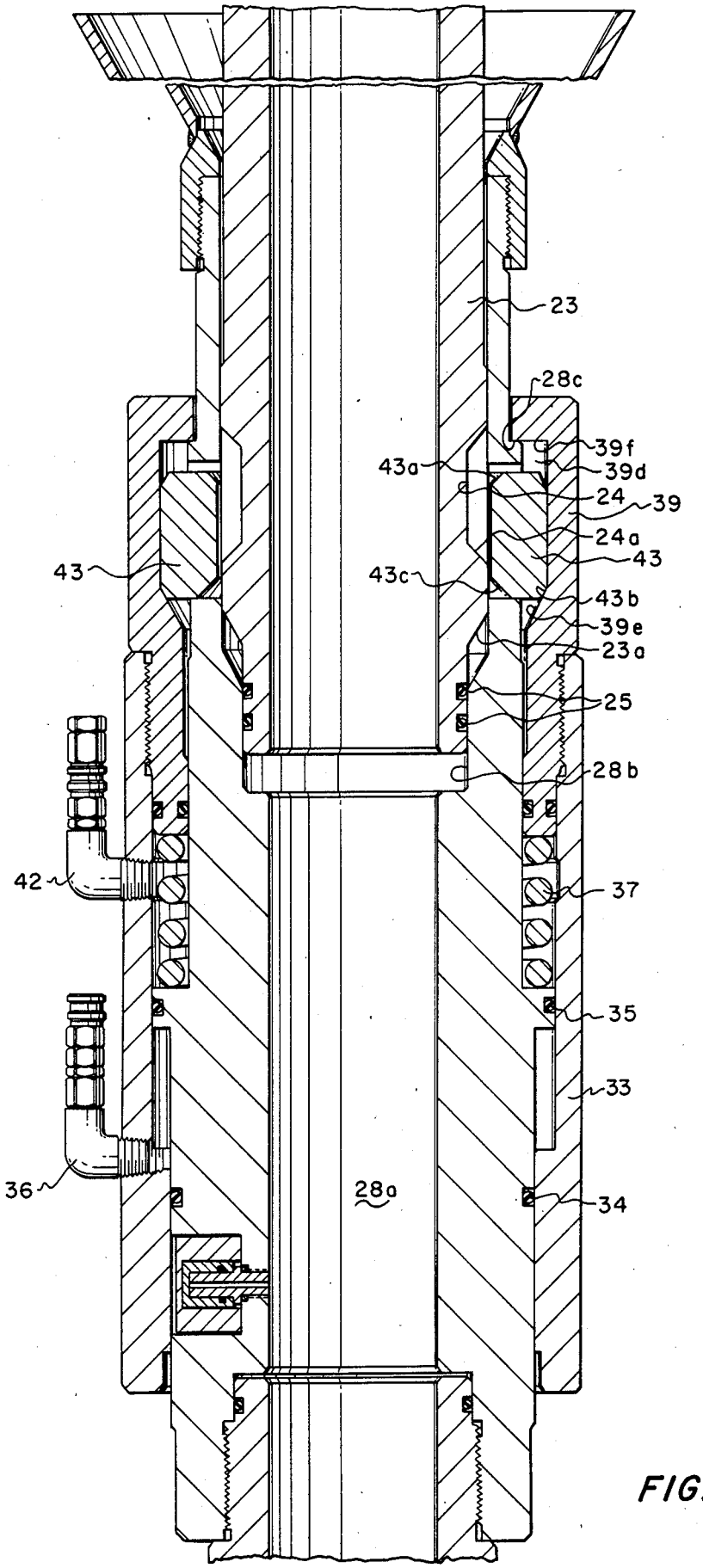
FIG. 4 is a sectioned drawing of the connector of this invention showing the members disconnected and moved slightly apart.

To utilize the connector of this invention and connect the male and female members, as shown in FIG. 2, the male member 23 is connected to the lower end of the equipment to be connected to the wellhead and the female member 26 is connected to the wellhead. If desirable, this connector may be inverted and the male member attached to the wellhead. It should be obvious that the connector of this invention is useful to connect pipes, cylindrical shapes and the like, and is operable in air or under water in any attitude. After connecting the male member, equipment with male member is lowered into guide 45. Pressure is then applied from the remote pressure source through the conduit and inlet 36 to act on the annular sealed area between seals 34 and 35. Sufficient pressure on this area will move sleeves 33 and 39 downwardly, compressing spring 37, until lock sleeve shoulder 39*f* contacts body shoulder 28*c* and recess 39*d* is beside dogs 43, as shown in FIG. 4. As the male member is lowered further, camming surface 23*a* may contact surface 43*a* on lugs 43 and move the lugs out into lock sleeve recess 39*d*, clearing the way for male member seals 25 to travel down and sealingly engage body seal bore 28*b*, and position groove 24 inside the lugs.

Now, pressure at inlet 36 is reduced until spring 37 moves sleeves 33 and 39 upwardly until lock sleeve surface 39*e* contacts dog surface 43*b* and cams lugs 43 radially in from recess 39*d* and into engagement with male member groove 24. On continued upward movement of sleeve 39, bore 39*b* moves up over the lugs, locking them in groove 24, and the male and female connector members connected. If desired, pressure may now be applied through inlet 42 to act on the sealed annular area between seals 35 and 41 to prevent any downward movement of sleeves 39 and 33 and retain the connector connected and locked connected.

To unlock and disconnect the connector of this invention, when there is no pressure in body bore 28*a*, pressure in inlet 36 is increased sufficiently to compress spring 37 and move sleeves 33 and 39 downwardly until lock sleeve recess 39*d* is outside lugs 43. At that time, male member 23 may be lifted disengaging seals 25 from body bore 28*b*, until groove cam surface 24*a* contacts lug surface 43*c*. Further upward movement of the male member will cam lugs 43 into lock recess 39*d*, as shown in FIG. 4 and permit the male member 23 to be freely lifted and disconnected from female member 26.

Figure 5:
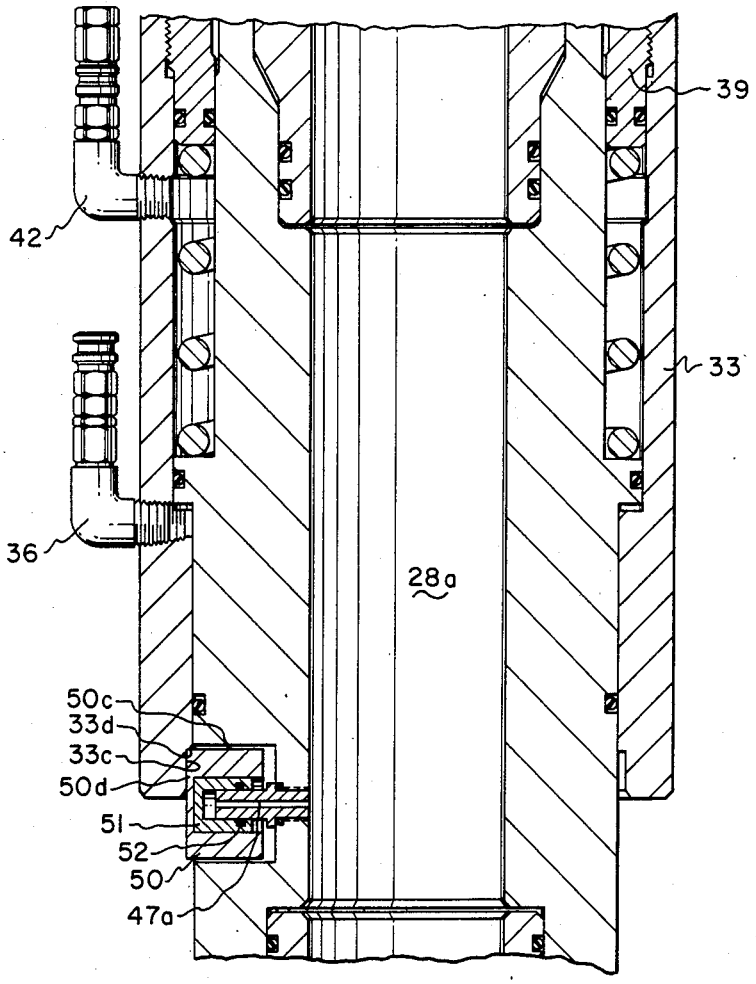
FIG. 5 is a fragment of drawing FIG. 2, showing the connector lock actuated.

When there is about 100 psi or more pressure in body bore 28*a*, the connector cannot be unlocked and disconnected even if pressure is increased in inlet 36 to move sleeves 33 and 39 downward to unlock the connector. Pressure in bore 28*a* acts through flow passage 47*a* on the area sealed by seal 52 and urges piston 51 and sleeve stop 50 to move out of the body wall recess and compress springs 54. A pressure of about 100 psi or more in bore 28*a* is sufficient to move the sleeve stop outwardly until stop surface 50*d* contacts sleeve bore 33*c*, as shown in FIG. 5. After sleeve shoulder 33*d* contacts stop surface 50*c*, no further downward movement of sleeves 33 and 39 may occur even if pressure is applied in inlet 36 and the connector cannot be unlocked and disconnected until pressure in bore 28*a* is reduced to below about 100 psi, and springs 54 move piston 51 and stop 50 back into the body wall recess, disengaging shoulder 33*d* and surface 50, and allowing sleeve bore 33*a* to be moved downwardly over sleeve stop 50.

We claim:

1. A remotely operable connector comprising:

a. a male tubular connector member having resilient seals thereon; and b. female connector means sealingly engageable with and connectable to said male connector member, including latch means for connecting said male member to said female connector means, said latch means including a body having a through bore, pressure responsive locking and release means moveable between locked and released positions and biased toward locked position, for locking said latch means latched and for releasing said latch means, connector lock means, mounted in said latch body and responsive to pressure in said body, preventing movement of said lock and release means to said released position, said connector lock means including a radially moveable lock body having holes therethrough and a blind hole therein, a shouldered fastener, disposed in each of said lock body through holes and fastened to said latch body, a spring disposed around each fastener biasing said lock body inwardly, a piston rod, disposed in said lock body blind hole and fastened to said latch body, having a hole therethrough communicating with said latch body bore, and a closed end piston sealingly and slidably disposed over said rod and slidably disposed in said lock body blind hole.

2. The connector of claim 1 including remote pressure source means connected to the locking and release means for remote operation of said means.

3. The connector of claim 1 wherein the female connector latch means further include an external shoulder on the latch body and openings in said body, and a lug mounted for radial movement in each opening.

4. The connector of claim 3 wherein the body has a frustoconical guide on one end.

5. The connector of claim 3 wherein the lock and release means comprise:

a. a longitudinally moveable sleeve mounted on the female connector latch body in sealing engagement therewith and defining a first pressure chamber on one side of the female connector body shoulder having an inlet therein, and a second pressure chamber on the other side of the female connector body shoulder having an inlet therein, and b. a spring disposed around said body in said second pressure chamber biasing said sleeve toward locked position.

6. The connector of claim 5 including a remote pressure source connected to the first and second pressure chamber inlets for selective introduction of pressure in said inlets.

7. A remotely operable connector comprising:

a. a male tubular connector member having resilient seals and an exterior groove thereon;

b. a female connector, which telescopes over and sealingly engages said male connector, including:

a body having a bore therethrough, an external shoulder thereon and openings therein, a lug mounted for radial movement in each opening, a longitudinally moveable sleeve mounted on said body in sealing engagement therewith to define a first pressure chamber having an inlet on one side of said body shoulder and a second pressure chamber having an inlet on the other side of said body shoulder, said sleeve biased by a spring around said body in said second chamber to an extended position locking said lugs securely connected in said male connector groove, said sleeve being pressure lockable in said extended position on introduction of pressure into said pressure chamber and said sleeve being movable to a contracted position releasing said lugs from said male connector groove by introducing pressure into said first chamber sufficient to overcome said sleeve bias, a pressure responsive connector lock, housing in said female body wall and responsive to pressure in said body bore, for preventing said sleeve from being moved to said contracted position including, an exterior recess in said body wall, a lock body, mounted for radial movement in said recess and having holes therethrough and a blind hold therein, a shouldered fastener, disposed in each of said lock body through holes, and fastened in said recess, a spring disposed around each fastener, biasing said lock body inwardly not preventing movement of said sleeve to said contracted position, a piston rod, disposed in said lock body blind hole, fastened in said recess and having a hole therethrough communicating with said female body bore, and a closed end piston sealingly and slidably disposed over said rod and slidably disposed in said lock body blind hole.

8. The connector of claim 7 including a remote pressure source connected to the first and second pressure chamber inlets for selective introduction of pressure into said pressure chambers.

* * * * *

UNITED STATES PATENT AND TRADEMARK OFFICE

CERTIFICATE OF CORRECTION

PATENT NO. : 4,667,986

DATED : May 26, 1987

INVENTOR(S) : David J. Johnson, Garland, Tex.;
Mark L. McGinnis, Ventura, Calif.

It is certified that error appears in the above—identified patent and that said Letters Patent is hereby corrected as shown below:

On the Title Page:

At [75] add inventors:

William H. Turner, Kincardineshire, Scotland; and
Ivan. K. Slaughter, Montrose, Angus, Scotland

Signed and Sealed this

Twentieth Day of October, 1987

*Attest:*

DONALD J. QUIGG

*Attesting Officer*

*Commissioner of Patents and Trademarks*